United States Patent [19]

Mantell

[11] 3,988,568

[45] Oct. 26, 1976

[54] HEATED HEAD ENCLOSURE

[76] Inventor: Jo Marie Mantell, 6201 - 63 Shoup, Woodland Hills, Calif. 91364

[22] Filed: Aug. 22, 1975

[21] Appl. No.: 606,797

[52] U.S. Cl. ..... 219/211; 2/183; 128/380; 219/527; 219/535

[51] Int. Cl.[2] ..... H05B 1/00

[58] Field of Search ..... 219/211, 527–529, 219/535; 128/379, 380; 2/183, 171, 171.1

[56] References Cited

UNITED STATES PATENTS

| | | | |
|---|---|---|---|
| 2,488,793 | 11/1949 | Amerkan | 219/527 X |
| 3,134,891 | 5/1964 | Hyer | 219/211 |
| 3,687,143 | 8/1972 | Schneeberger et al. | 219/211 X |
| 3,748,436 | 7/1973 | Cossaboam | 219/211 |

FOREIGN PATENTS OR APPLICATIONS

| | | | |
|---|---|---|---|
| 481,061 | 10/1951 | Italy | 219/527 |

*Primary Examiner*—C. L. Albritton
*Attorney, Agent, or Firm*—Lyon & Lyon

[57] ABSTRACT

A head enclosure including two complementary cover members having heating elements therein, shaped to conform to opposite sides of the users head, and including permanently connected portions covering the back of the user's neck, the margins of the cover members extending in centered relation over the crown of the user's head having flexible readily detachable fastening means which are variable in their width of attachment to adjust the cover members to the dimensions of the user's head, and including a removable and adjustable neck strap, whereby upon detaching the marginal fastener means both cover members may rest on the shoulders of the user retained by the neck back covering portions and neck strap.

8 Claims, 7 Drawing Figures

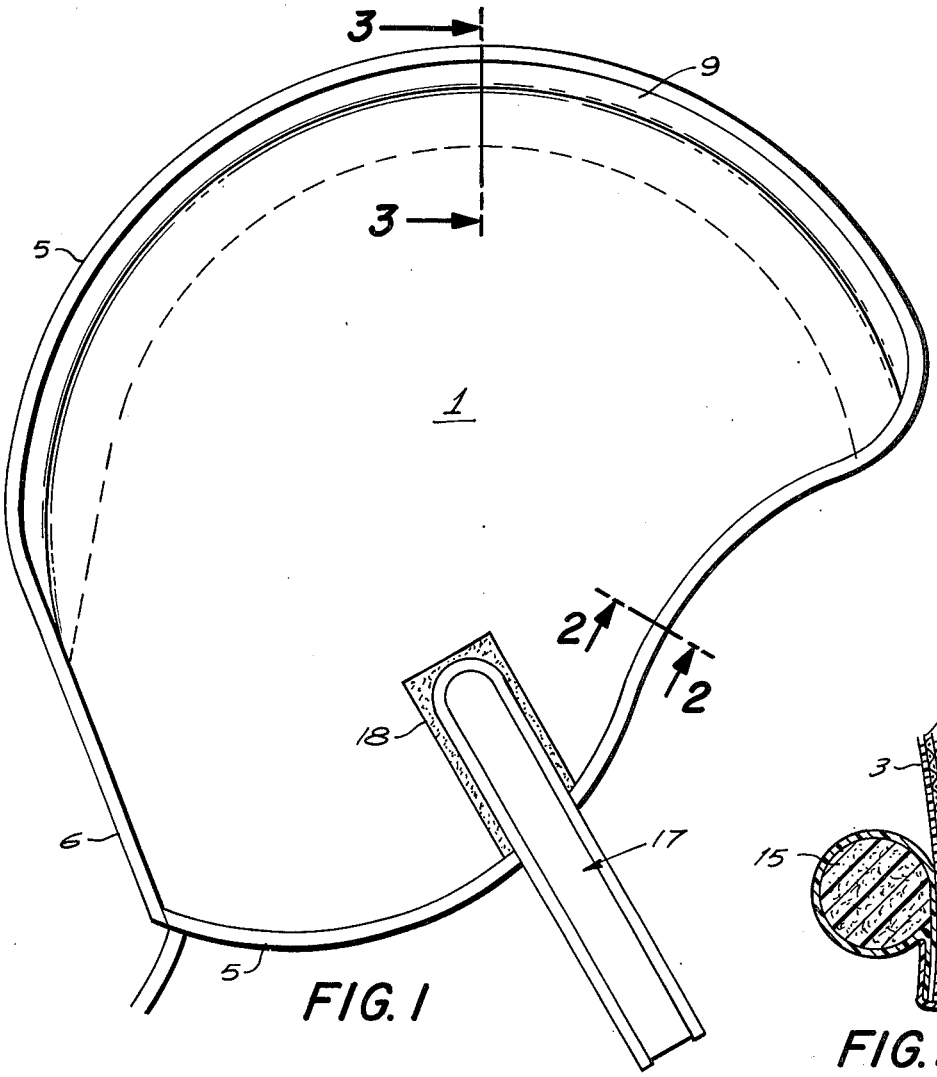
FIG. 1
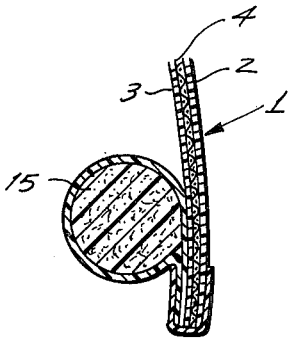
FIG. 2
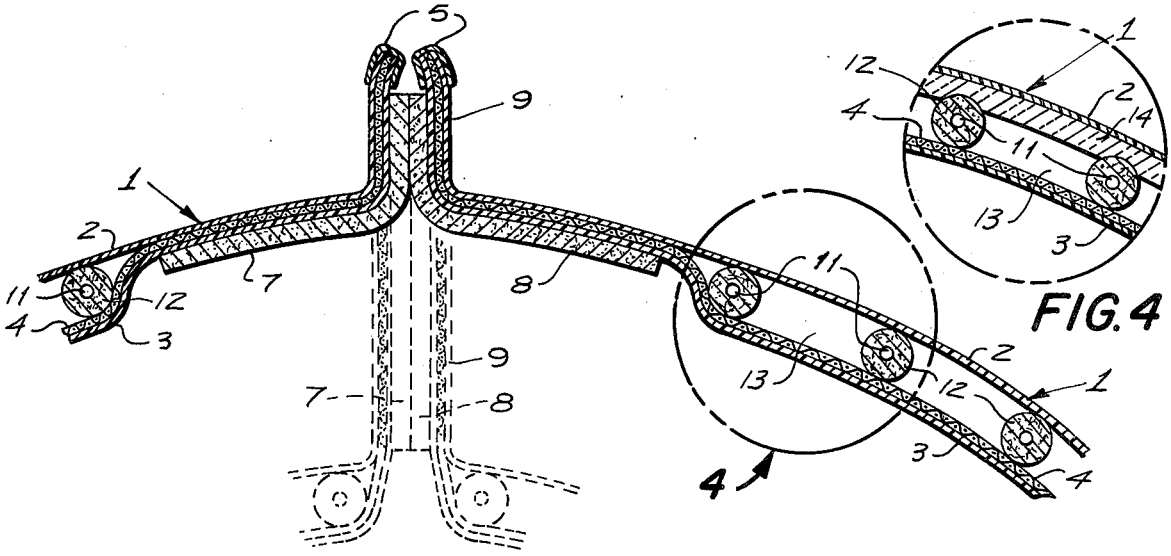
FIG. 4
FIG. 3

HEATED HEAD ENCLOSURE

BACKGROUND

Permanent waving of the hair is best accomplished by heat; however, heat is usually avoided due to discomfort to the customer. Permanent heat setting chemicals have been developed involving various formulations to improve the hair; however this treatment has increased the need to apply moderate heat. Conventional hair dryers using hot air or heat lamps have been used which generate an excess amount of heat with discomfort to the customer.

SUMMARY

The present invention is directed to a heated head enclosure which is particularly adapted for use in conjunction with permanent wave treatment, and is summarized in the following objects:

First, to provide a heated head enclosure, which includes complementary members having heating elements therein, and joined by non-metallic separable fastener means in such a manner that the enclosure may be readily adjusted to the customer's head.

Second, to provide a heated head enclosure, as indicated in the preceeding object, wherein the complementary members are capable of ready partial separation while supported about the customer's neck to expose the hair for examination and application of hair treatment chemicals, then readily readjusted to the user's head.

Third, a heated head enclosure, as indicated in the other objects, wherein the heating elements are so arranged as to apply greater heat to the crown of the head having the greater hair covering and lesser heat in the regions of the ears to minimize discomfort; and wherein the heat is efficiently applied under temperature control to confine the total amount of applied heat to that required for adequate chemical response.

DESCRIPTION OF THE FIGURES

FIG. 1 is a side view of the heated head enclosure shown by solid lines as arranged to have maximum volume, and by dotted lines as arranged to have reduced volume.

FIG. 2 is an enlarged fragmentary sectional view taken through 2—2 of FIG. 1, showing the marginal sealing pad.

FIG. 3 is an enlarged fragmentary sectional view taken through 3—3 of FIG. 1, showing the manner in which the complementary cover members are joined together to provide maximum size, and indicating by broken lines the manner in which the effective size is reduced.

FIG. 4 is a fragmentary sectional view taken within Circle 4 of FIG. 3, showing the enclosure as arranged for increased insulation against outward flow of heat.

DETAILED DESCRIPTION

Figure 5:
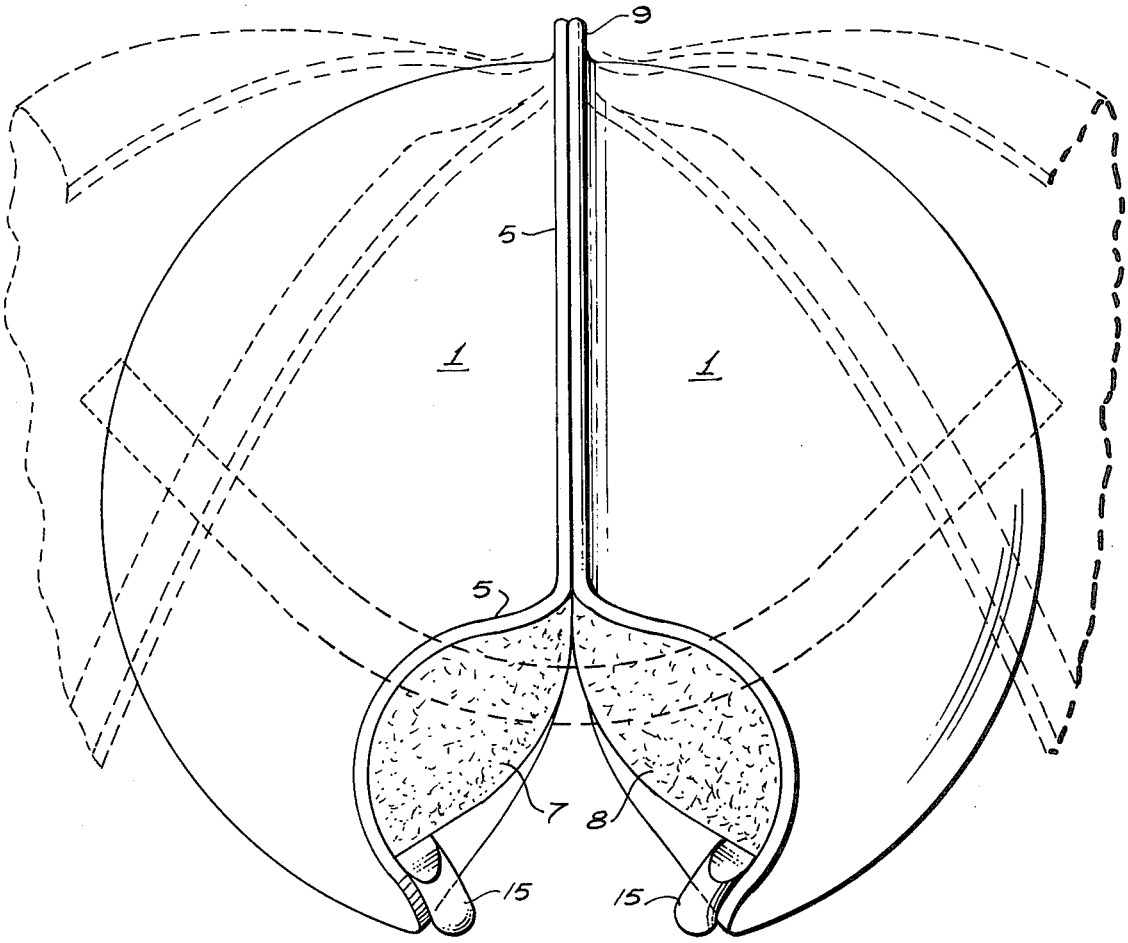
FIG. 5 is a top view of the heated head enclosure showing the complementary cover members when partially separated. And indicating by broken lines the manner in which the complementary cover members may be further separated while attached to a neck band, whereby the enclosure may rest on the shoulders of the user.

The heated head enclosure includes a pair of complementary cover members 1. Each cover member includes an outer lamination 2 and an inner lamination 3. Between these laminations is an intermediate heating element supporting lamination 4. The outer and inner laminations are preferably formed of plastic material capable of withstanding the temperatures involved. The intermediate lamination 4 is preferably formed of canvas-like fabric.

While the inner and outer laminations may be molded to the desired shape, these laminations, as well as the intermediate lamination may be formed of initially flat material then cut and sewn in a conventional manner to approximate the shape of one-half of the human head. The edges of each cover member are provided with a marginal binding 5, the two cover members are permanently joined in center relation to the back of the neck as indicated by 6.

The confronting portions of the cover members continuing from the region 6 over the crown of the head, are provided with separable fiber fastener strips 7 and 8. For example, but not intended as a limitation, these strips may be the type manufactured under the trademark VELCRO, when the fastener strips are pressed together they form a crown rib 9. If the minimal width of these strips is used, as shown by solid lines in FIGS. 1 and 3, the cover members define a maximum volume whereas if the entire width of the strips is utilized, the crown rib is increased in radial depth, as indicated by broken lines in FIGS. 1 and 3 and the effective volume encompassed by the cover members is reduced.

When the cover members are joined together they define an opening extending across the forehead, down the cheeks and along the opposite sides of the neck, in other words, the cover members encompass the scalp and the ears of the user and expose the face. The margins of the opening formed by each cover member is provided internally with a marginal pad 15.

Figure 6:
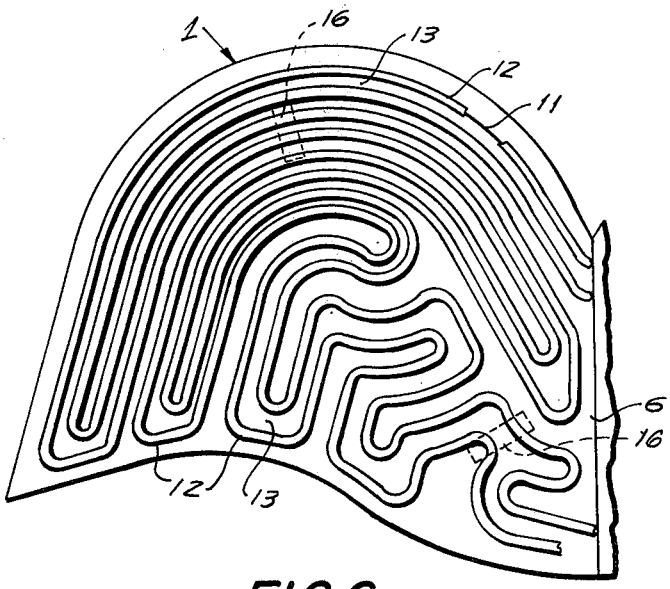
FIG. 6 is a reduced essentially developed view, showing the distribution of the heating element provided in the cover member.

Each cover member 1 receives a heating element 11 which is incased in a wrapping 12 providing both heat and electrical insulation. The wrapping is sewn to the supporting lamination 4. The heating elements are preferrably arranged as suggested in FIG. 6 in such a manner that the areas of the head having the greater amount of hair are also subject to a more dense arrangement of the heating element, whereas in the region of the ears the heating elements are spaced a greater distance. The spaces between the covered heating elements form air chambers 13.

As indicated in FIG. 4, a lamination 14 of heat insulating material may be interposed between each lamination 2 and wrapping 12. Also for heat retention and comfort, the margin of each cover member 1 is provided with a pad 15 of circular cross section.

Figure 7:
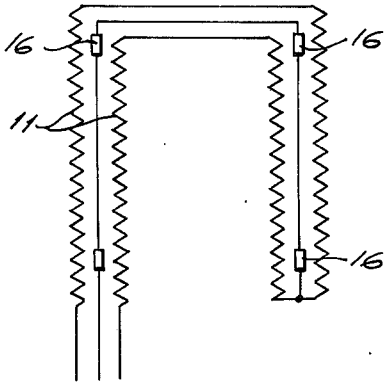
FIG. 7 is a wiring diagram of the electrical components of the enclosure.

Each cover member may be provided with a pair of heating elements joined in series, as indicated in FIG. 7, and of different wattage so that they may be used alternatively to provide a low and medium heat and in combination to provide a high heat. Appropriate thermostat elements 16 may be provided.

As previously indicated, heat is required but the conventional sources of heat, such air circulating hair dryers or heat lamps do not provide effective control of heat and are both uncomfortable and involve substantial wastage of heat in the surrounding area.

Operation of the heated head enclosure is as follows:

After the operator has prepared the hair by use of the permanent waving solution and has rolled hair on curlers the two cover members 1 are pivoted toward each other and over the customer's head, bringing the fastener strips 7 and 8 into mutual contact to form the crown rib 9. As the cover members are brought in place the crown rib is increased in width until the enclosure is fitted to the head. As this is accomplished, the marginal pad 10 forms a seal around the margins of the opening into the enclosure and is sufficiently soft as to fit with comfort.

The heating elements are activated, but because of the insulation afforded by the wrapping 12, the heat becomes distributed in the enclosure heating the air chambers 13, resulting in uniform distribution of heat and absence of hot spots. To reduce outward flow of heat from the head enclosure, an insulation lamination 14 may be added as shown in FIG. 4. One of the essential requirements in the use of the permanent waving solution, is that for best results the hair should be inspected several times during the permanent waving process, this requires that the enclosure be removed or partially removed. If it's merely necessary to inspect the hair immediately beyond the forehead, partial pealing back of the cover members as suggested in FIG. 5 is sufficient. If further inspection is needed the cover members may be opened fully, as indicated by broken lines in FIG. 5 with the chin strap 15 remaining in place so that the head enclosure may rest on the shoulders of the user, and thus is ready for quick replacement after inspection and possible treatment of the hair. This is far more convenient than if it were necessary to completely remove the head enclosure and set it aside.

Having fully described my invention it is to be understood that I am not to be limited to the details herein set forth, but that my invention is of the full scope of the appended claims.

I claim:

1. A head enclosure for applying heat to the head of a customer undergoing hair treatment, comprising:

a. a pair of complementary cover members adapted to conform approximately to opposite sides of the customer's head and having front margins defining an opening for exposing the face of the customer;

b. each cover member having a top margin adapted to extend from the back of the neck over the crown of the head to the forehead of the customer;

c. a continuous non-conductive separable fastener band extending along each top margin on the inner face of each, the bands being continuously engageable lengthwise to minimize escape of heat from the cover members, and mutually, engageable a variable transverse extent to change the effective size of the cover members;

d. and heating elements distributed within each cover member.

2. A head enclosure, as defined in claim 1, wherein:

a. the fastener blade being variably foldable transversely and yieldable to form head confronting portions of variable width and outwardly extending rib portions also of variable width.

3. A head enclosure, as defined in claim 1, wherein:

a. a neck strap is adapted to connect the cover members across the neck of the customer, and the cover members being movable laterally from each other and adapted to rest on the shoulders of the customer while restrained by the strap to expose the head of the customer for inspection and treatment.

4. A head enclosure, as defined in claim 1, wherein:

a. the margins of the cover members at the back of the neck extending beyond the fastener bands and are permanently joined;

b. and a strap including a separable end is adapted to extend across the neck of the customer and be joined to the cover members to retain the cover members on the customer's head when the cover members are joined and to retain the cover members about the neck of the customer when the fastener bands are disengaged.

5. A head enclosure, as defined in claim 1, wherein:

a. the cover members include an exterior lamination, an interior lamination and an intermediate heating element supporting lamination;

b. and the heating elements are incased in heat and electrical insulation material and disposed in spaced relation to form heat receiving chambers therebetween for distributed flow of heat through the inner lamination.

6. A head enclosure, as defined in claim 5, wherein:

a. a further lamination of heat insulating material underlies the exterior lamination.

7. A head enclosure for applying heat to the head of a customer undergoing hair treatment, comprising:

a. a pair of cover members adapted to overlie complementary top and side portions of a customer's head including the ears and form an opening adapted to expose the portions of the customer's head beyond the hair covering;

b. separable fastener elements joining confronting margins of the cover members;

c. and heating elements distributed in the cover members, the heating elements including a main heat transfer portion extending between the neck and forehead of the customer and reduced heat transfer portions overlying the ears of the user.

8. A head enclosure for applying heat to the head of a customer undergoing hair treatment, comprising:

a. a pair of complementary cover members adapted to conform approximately to opposite sides of the customer's head and forming an opening for exposing the face of the customer;

b. each cover member having a margin adapted to extend between the back of the neck over the crown of the head to the forehead of the customer;

c. a fiberous separable fastener element extending along each margin for mutual engagement to join the cover members;

d. a ring of padding material encircling the opening formed by the cover members to entrap heated air within the cover members;

e. and heating elements distributed within each cover member.

* * * * *